US010836202B2

(12) United States Patent
Zweymüller

(10) Patent No.: US 10,836,202 B2
(45) Date of Patent: Nov. 17, 2020

(54) DEVICE FOR ACCOMMODATING PUNCHED SHEETS

(71) Applicant: Albert Zweymüller, Vienna (AT)

(72) Inventor: Albert Zweymüller, Vienna (AT)

( * ) Notice: Subject to any disclaimer, the term of this patent is extended or adjusted under 35 U.S.C. 154(b) by 0 days.

(21) Appl. No.: 16/341,593

(22) PCT Filed: Sep. 19, 2017

(86) PCT No.: PCT/EP2017/073558

§ 371 (c)(1),
(2) Date: Apr. 12, 2019

(87) PCT Pub. No.: WO2018/072945

PCT Pub. Date: Apr. 26, 2018

(65) Prior Publication Data

US 2020/0009898 A1 Jan. 9, 2020

(30) Foreign Application Priority Data

Oct. 17, 2016 (DE) ..... 10 2016 119 732

(51) Int. Cl.
*B42F 13/24* (2006.01)
*B42F 13/26* (2006.01)
(Continued)

(52) U.S. Cl.
CPC ..... *B42F 13/0026* (2013.01); *B42F 13/004* (2013.01); *B42F 13/008* (2013.01);
(Continued)

(58) Field of Classification Search
CPC ..... B42F 13/24; B42F 13/26
(Continued)

(56) References Cited

U.S. PATENT DOCUMENTS 4,486,112 A * 12/1984 Cummins ..... B42F 13/20 402/34
4,750,884 A * 6/1988 Bourgeois ..... B42F 13/0086 402/13

(Continued)

FOREIGN PATENT DOCUMENTS

DE 3004830 A1 * 8/1980 ..... B42F 13/24
DE 3004830 A1 8/1980

(Continued)

OTHER PUBLICATIONS

"International Application No. PCT/EP2017/073558, International Preliminary Report on Patentability dated May 2, 2019", 11 pgs.

(Continued)

*Primary Examiner* — Kyle R Grabowski
(74) *Attorney, Agent, or Firm* — Schwegman Lundberg & Woessner, P.A.

(57) ABSTRACT

A device for accommodating punched sheets, in particular loose sheets of paper, and a folder, in particular a binder, having such a device is provided. The device comprises a base plate, at least two retainer bracket pairs designed to be openable and closable, each of which having a first bracket and a second bracket, wherein the at least two first brackets are connected to each other by a bracket connector that is connected to the base plate so as to be rotatable about an axis of rotation that runs parallel to the base plate, and is connected to a pivot lever. The device further comprises a carriage that is displaceably mounted on the base plate, wherein the carriage has a link that guides the pivot lever and is designed such that, when the carriage is displaced, the link determines a rotational movement of the pivot lever about the axis of rotation, which is parallel to the base plate, in both directions of rotation.

24 Claims, 13 Drawing Sheets

(51) Int. Cl.
*B42F 13/00* (2006.01)
*B42F 13/40* (2006.01)

(52) U.S. Cl.
CPC ..... *B42F 13/26* (2013.01); *B42F 13/24* (2013.01); *B42F 13/40* (2013.01); *B42P 2241/06* (2013.01)

(58) Field of Classification Search
USPC ..... 402/30–31, 34, 42
See application file for complete search history.

(56) References Cited

U.S. PATENT DOCUMENTS

| | | | | |
|---|---|---|---|---|
| 4,995,752 | A * | 2/1991 | Hofmann | B42F 13/24 402/34 |
| 7,331,732 | B2 * | 2/2008 | Kaneda | B42F 13/26 402/31 |
| 7,524,127 | B2 * | 4/2009 | Petrie | B42F 13/26 402/19 |
| 2003/0099503 | A1 * | 5/2003 | Moor | B42F 13/0006 402/73 |

FOREIGN PATENT DOCUMENTS

| | | | | |
|---|---|---|---|---|
| DE | 8705538 | | 6/1987 | |
| DE | 9301485.6 | U1 | 3/1993 | |
| DE | 19619822 | A1 | 11/1997 | |
| DE | 202010017064 | | 4/2011 | |
| DE | 202010017064 | U1 * | 4/2011 | B42F 13/24 |
| DE | 102013011498 | A1 | 1/2015 | |
| FR | 603633 | A | 4/1926 | |
| GB | 196329 | A | 4/1923 | |
| WO | WO-2018072945 | A1 | 4/2018 | |

OTHER PUBLICATIONS

"German Application No. 10 2016 119 732.7, Search Report dated Feb. 20, 2018", (dated Feb. 20, 2018), 7 pgs.
"International Application No. PCT/EP2017/073558, International Search Report and Written Opinion dated Feb. 1, 2018", (dated Feb. 1, 2018), 19 pgs.

* cited by examiner

DEVICE FOR ACCOMMODATING PUNCHED SHEETS

PRIORITY CLAIM TO RELATED APPLICATIONS

This application is a U.S. national stage filing under 35 U.S.C. § 371 of International Application No. PCT/EP2017/073558, filed on 19 Sep. 2017, and published as WO2018/072945 on 26 Apr. 2018, which claims priority to German Application No. 10 2016 119 732.7, filed on 17 Oct. 2016, the benefit of priority of each of which is claimed herein, and which applications and publication are hereby incorporated herein by reference in their entirety.

The invention relates to a device for accommodating punched sheets according to claim 1 and a folder, in particular an erectable ring binder, according to claim 19.

DE 20 2010 017 064 U1 discloses an erectable folder for accommodating individual sheets with a front and rear cover and a spine connecting the two covers. The folder comprises a sheet stringing mechanism comprising a plate mounted on the rear cover, a pair of fixed stringing rods and a pair of movable legs connected to a folding bracket and collapsible with the stringing rods. The folding bracket comprises a shaft with a mandrel. A sliding carriage has an inclined plane, which pushes the mandrel downwards against the rear cover during a sliding movement to close the folding bracket. In the case of an opposite sliding movement, the inclined plane releases the mandrel upwards. The spring force of the spring-loaded springs attached to the rear cover pushes the mandrel upwards to open the folding bracket.

The disadvantage of this mechanism is that the closing and opening of the folding bracket is not completely defined by the displacement of the carriage. In the event of a defect in the spring-loaded pins, the folding bracket cannot be opened, or only to a limited extent, via the sliding mechanism. In addition, intermediate positions of the folding bracket during the opening movement, for example to remove a single sheet from the folder, are difficult to adjust, especially with high spring force. If the spring force is again too low to move a stack of sheets on the side of the folding bracket during opening, the opening of the folding bracket must be supported manually.

It is therefore the object of the present invention to provide a device for accommodating punched sheets and a folder with such a device in which the opening and closing of the retaining brackets can be reliably and precisely carried out while ensuring the greatest possible flexibility in the insertion and removal of the punched sheets. In particular, sheets should be able to be lined up on both sides of the retaining brackets.

This object is solved by a device for accommodating punched sheets according to claim 1 and a folder according to claim 19.

The object is solved in particular by a device for accommodating punched sheets, in particular loose sheets of paper, comprising the following:

a base plate, at least two pairs of retaining brackets, which are designed to be openable and closable and each have a first bracket and a second bracket, wherein the at least two first brackets are connected to one another via a bracket connector, which is connected to the base plate so as to be rotatable about an axis of rotation extending parallel to the base plate and is connected to a pivot lever, and a carriage which is displaceably mounted on the base plate, wherein the carriage has a link which guides the pivot lever and is designed such that, when the carriage is displaced, the link determines a rotational movement of the pivot lever about the axis of rotation parallel to the base plate in both directions of rotation.

The device is particularly suitable for accommodating punched loose sheets of paper, cardboard or plastic and sleeves of plastic film with a perforated filing edge. The perforation can comply with the various international standards, in particular with regard to hole spacing and hole size, and the various hole systems, for example with 2-fold, 3-fold or 4-fold perforation. The format of the sheets to be accommodated by the device can correspond to the various international standard formats. The device is preferably used for folders or loose-leaf collections and can be adapted in its dimensioning and dimensions, in particular with regard to the height of the pairs of retaining brackets and/or the length of the carriage. The device can also be used as an independent accommodating device for punched sheets, sheets or pages.

In particular, two pairs of retaining brackets are provided for sheets with a 2-fold perforation, three pairs of retaining brackets for sheets with a 3-fold perforation and four pairs of retaining brackets for sheets with a 4-fold perforation. However, more than four pairs of retaining brackets can also be provided.

The base plate can be single or multi-piece and have different shapes, dimensions and thicknesses, in particular a variable thickness. The base plate, for example, is about 3 mm thick and made of plastic, especially fiber-reinforced plastic. The base plate is preferably located on the inside of the back cover of a file folder or loose-leaf collection. The base plate can also be part of the back of a folder or replace it completely. In particular, the base plate can be designed as the back cover of a folder.

Preferably, the second bracket is fixed relative to the base plate, in particular fixed to the base plate, while the first bracket is pivotable relative to the base plate. The first brackets are connected to each other by a bracket connector, in particular are made in one piece with web parts of the bracket connector or are firmly connected to these, so that the first brackets perform a joint pivoting movement about the axis of rotation of the bracket connector. At least two second brackets can be connected via a carrier plate. However, both brackets can also be pivotable relative to the base plate. In this case, one pivot leaver each could be provided, especially on both sides of the carriage, wherein the same link could guide both pivot levers, or different links could guide one each of the pivot levers. The pairs of retaining brackets and the bracket connector are preferably made of metal.

When closed, the pairs of retaining brackets form, in particular, a continuous retaining bracket, which arranges the sheets accommodated by the device neatly one on top of the other as a pile of sheets which can be scrolled through and which enables the rearrangement of stapled sheets or parts of the stack from one side of the device to the other, i.e. from the first bracket to the second bracket, or vice versa. When the pairs of retaining brackets are open, the sheets accommodated in the device can be removed or inserted on the side of the first bracket and on the side of the second bracket, in particular without the carriage blocking or obstructing their removal or insertion. The sheets can be lined up on both the first and the second bracket.

The axis of rotation of the bracket connector, which runs parallel to the base plate, defines two directions of rotation, one of which corresponds to an opening movement of the pair of retaining brackets and the other to a closing movement of the pair of retaining brackets. In the axial direction, the bracket connector is preferably fixed relative to the base plate. The pivot lever preferably protrudes from the bracket connector at a right angle to the axis of rotation of the bracket connector, in particular in the middle, but can also be arranged at an inclination to the axis of rotation of the bracket connector. The pivot lever is preferably connected to the bracket connector in a fixed manner, in particular a rotationally fixed manner, and is slidably guided in particular in or on the link. The pivot lever can preferably be pivoted in a plane perpendicular to the base plate. The pivot lever is preferably rigid, but can also have several members with a joint. The pivot lever can extend from the bracket connector to the link, into the link or through the link.

The carriage can be designed in one or more parts. The carriage is preferably displaceably mounted parallel to the axis of rotation around which the bracket connector is rotatably connected to the base plate. The carriage is in particular manually operable, wherein preferably at at least one end of the carriage a handle is formed, preferably in the form of a ring or loop, for the engagement of a human finger, in order to displace the carriage preferably in its longitudinal direction, in particular sliding on the base plate. The carriage preferably has a longitudinal slot in which the carriage is guided by pins connected to the baseplate, in particular integral pins connected to the base plate. The pins can also be attached to the carriage or the base plate can have one or more grooves in which the carriage is guided.

A link can be understood as an area of the carriage or a separate body which is connected to the carriage or, for example, accommodated in it, which guides a pivot lever due to a kinematic coupling in such a way that a path of movement of the pivot lever is determined taking into account the given kinematic constraints. The link and the pivot lever form a link guide. The link may be made of a different material, in particular a harder or more wear-resistant material than the carriage or other parts of the carriage.

The link determines the rotational movement of the pivot lever in both directions of rotation, in that it defines or prescribes the path of movement of the lever in both possible directions of rotation about the axis of rotation of the bracket connector, in particular unambiguously. A displacement of the carriage is kinematically converted by means of the link and the pivot lever, in particular into a rotation of the bracket connector, in order to effect an opening or closing movement of the retaining bracket pairs. In particular, a translational movement of the carriage is converted into a rotational movement of the bracket connector and the first bracket connected to it. In particular, the displacement of the carriage in one direction causes an opening movement, and a displacement of the carriage in the other direction causes a closing movement of the retaining bracket pairs. However, it may also be provided that a displacement of the carriage does not cause rotation of the bracket connector, i.e. if the link guides the pivot lever in such a way that an angle is determined between the pivot lever and the base plate, but does not change during a displacement of the carriage. This is particularly the case if the link guides the pivot lever, in particular a guide end of the pivot lever, in sections in a plane parallel to the base plate.

The device according to the invention has the advantage that the opening and closing of the pairs of retaining brackets, in particular the degree of opening and closing and the course of movement, i.e. for example the speed and the opening end position, is determined by the displacement of the carriage, preferably clearly by the position of the carriage relative to the base plate. This allows the opening angle between the first bracket and the second bracket to be precisely and reliably adjusted by moving the carriage to insert or remove sheets from the device. In particular, when the retaining bracket pairs are open, punched sheets can be inserted and removed unhindered both on the side of the first bracket and on the side of the second bracket. The retaining bracket pairs can be reliably closed by moving the carriage.

In an advantageous further development of the invention, the link has a guide recess or a guide rail. A guide recess can, for example, be designed as a guide slot open on both sides or a guide groove open on one side. The pivot lever, in particular a guide end of the pivot lever, may be guided in a guide recess or on a guide rail, for example along a spiral path, a curved path or in a straight line. A guide recess or guide rail preferably has a uniform inclination relative to the base plate in a plane perpendicular to the base plate, for example in the form of a straight or curved guideway. This results in a continuous rotation of the pivot lever in one direction of rotation and thus a continuous opening and closing movement of the retaining bracket pairs. However, sections of the guide recess or the guide rail may also be provided which run parallel to the axis of rotation of the bracket connector, in particular parallel to the base plate, especially at the ends of the guide recess or the guide rail so that the first and second brackets of the retaining bracket pairs keep the distance between each other constant during the displacement of the carriage or the pivot lever maintains a constant angle to the base plate. In principle, however, it would also be conceivable to make the guide recess or guide rail uneven, for example wavy, so that the pairs of retaining brackets open and close relative to each other during the movement of the carriage in one direction.

In particular, the pivot lever is mounted in the guide recess or on the guide rail so as to be displaceable, in particular sliding. The pivot lever can be hinged to a block or pin running in the guide recess or can slide directly in the guide recess relative to the guide recess, for example in the form of a ball or hemisphere. In the case of a guide slot open on both sides, the pivot lever can extend through the guide slot. However, the pivot lever can only extend up to or into a guide slot or a guide groove. A guide slot that is open on both sides has the advantage that it is easy to produce. The guide recess may be grooved and/or undercut. A guide rail may, for example, be designed as a guide web or a protruding guide shoulder. The pivot lever could, for example, be hinged to a link carriage running on a guide rail.

In an advantageous further development of the invention, the guide recess is straight at least in sections in a cutting plane along the direction of displacement of the carriage. The guide recess can be straight over its entire length or curved in sections. In particular, curved sections may be provided as transitions between straight sections of the guide recess. In principle, the guide recess can also be curved over its entire length. In particular, the guide recess has inclined guide planes relative to the base plate and is preferably limited by these. A straight guide slot or a straight guide groove is easy to produce and functions reliably, for example even when dirty. A further degree of freedom in the radial direction of the pivot axis is to be provided in that a straight section of a guide recess leads to a path of movement of the pivot lever which deviates from the ideal spiral path which would describe a link guide having exactly one degree of freedom when the carriage is displaced parallel to the rotational axis of the pivot lever. This degree of freedom of the link guide is realized, for example, by a guide recess in which the pivot lever is also displaceably mounted in the transverse direction of the slide, i.e. in particular parallel to the base plate.

In an advantageous further development of the invention, the link is made in one piece with the carriage. This has the advantage that the carriage can be produced at low cost, for example by casting it from a plastic material. A guide recess in the carriage can, for example, already be provided during casting of the carriage or subsequently milled in.

In an advantageous further development of the invention, the pivot lever has a guide end which engages in the link, in particular in the guide recess. The pivot lever is preferably designed as a rigid pin, bolt, tube or mandrel, wherein the free end of the pivot lever forms the guide end, while the other end is firmly connected to the bracket connector. It can be adapted for guidance in the link, especially in the guide recess, for example by its shape and/or the material. A guide end could, for example, be rounded and/or coated, in particular to reduce wear on the link guide and improve the sliding properties. The material of the guide end can be matched to the material of the link, in particular its guide surfaces, preferably in terms of hardness and sliding properties. In particular, the material may be the same. A simple, robust and reliable link guide is achieved by the engagement of a guide end of the pivot lever into the link, which in particular makes do with as few moving parts as possible.

In an advantageous further development of the invention, the link is adapted in cutting planes parallel to the base plate in the direction of displacement of the carriage to the path of the guide end of the pivot lever, in particular curved. In particular, the link is shaped in a curved manner in vertical projection onto the base plate on the side facing the pivot lever, while it is formed in a straight manner on the other side. In particular, the link is wedge-shaped, widening towards the opening position of the pivot lever. Since the link, in particular the guide recess, is adapted to the path of the guide end of the pivot lever, which it describes when projecting onto the ground plane during the pivoting movement of the pivot lever, reliable guidance of the pivot lever is ensured. For example, it prevents the pivot lever from jumping out of the link or being diverted out, especially when the link guide is subjected to high loads.

In an advantageous further development of the invention, the guide end of the pivot lever is designed as a ball head. Due to the small contact area, the geometry of a ball or a hemisphere leads to good sliding properties of the link guide, especially in the longitudinal direction of the guide recess, on the one hand, and to tiltability of the pivot lever relative to the link, especially in a plane perpendicular to the base plate, on the other hand. A rigid pivot lever with a ball head as guide end can be guided along the degrees of freedom of the link with low friction losses. A ball head is able to ensure the same quality of power transmission at the different support points on its surface during the relative movement between the lever arm and the link. In particular, the design of the guide end as a ball head enables the device to be closed reliably and with relatively little effort even when the sheet stacks are resting on the first and/or second bracket.

In an advantageous further development of the invention, the guide recess is limited by guide surfaces, in particular a closing guide surface and an opening guide surface, which are wider than the diameter of the ball head of the pivot lever. The guide surfaces comprise in particular a closing guide surface and an opening guide surface, which cause the pairs of retaining brackets to close and open respectively, in that the guide end of the pivot lever, preferably the ball head, is in contact with one of these surfaces during the respective movement of the pairs of retaining brackets, in particular slides along them. The guide surfaces preferably run parallel, wherein the opening guide surface limits the guide recess towards the base plate, while the closing guide surface limits the guide recess on the side facing away from the base plate. Due to a widened design of the guide surfaces, the guide end of the pivot lever can slide sufficiently far in the guide recess in the transverse direction to the direction of displacement of the carriage to prevent it from jumping, sliding or slipping out of the guide recess.

In an advantageous further development of the invention, the closing guide surface projects laterally over the opening guide surface. In particular, the opening guide surface is narrower than the closing guide surface, wherein both surfaces can have a wedge-shaped pre-widening basic shape. For example, the projection is between 0.5 mm and 10 mm, preferably between 1 mm and 5 mm, especially preferably about 2 mm. The projection can be constant along the link or can change along the curved course of the link in particular. Since the opening guide surface jumps back relative to the closing guide surface it is ensured that the pivot lever is guided freely along the link, while it assumes an ever greater angle to the base plate as the pairs of retaining brackets open. Apart from this, the protrusion of the closing guide surface, in particular the wider design of the closing guide surface, allows the pressure on the pivot lever to be transmitted precisely even under heavy loads during the closing movement and prevents the pivot lever from slipping out of the slot, for example when a stack of paper is loaded on the first bracket.

In an advantageous further development of the invention, the link has latching and/or clamping elements at at least one end of the guide recess in order to fix the pivot lever releasably in an end position. In particular, the link has at at least one end of the guide recess a recess, in particular a spherical shell-shaped recess, into which the ball head of the pivot lever engages for fixing in an end position.

Latching and/or clamping elements can be provided on or in the closing guide surface and/or the opening guide surface. For example, clamping can be implemented through a tapering of the guide recess towards at least one end, for example by an increasingly raised edge of one of the guide surfaces on the side of the pivot lever. Preferably, resistance points in the form of edges or elevations in the guide surfaces are provided, which must be overcome by the guide end of the pivot lever when the carriage is moved, before the pivot lever engages or clamps, in particular with its guide end. The pivot lever could also be fixed in an end position, i.e. an opening or closing position of the pivot lever, in that sections of the guide recess or the guide rail are formed to extend parallel to the axis of rotation of the bracket connector, in particular parallel to the base plate, at the ends, for example over the length of approximately one diameter of the ball head. If a displacement movement of the carriage reaches an end point, the pivot lever would no longer rotate, but its rotational position would be determined by the closing guide surface and the opening guide surface.

A recess could be adapted to the shape of the guide end of the pivot lever. Preferably, it is hemispherical in shape, corresponding to the ball head. Such recesses are preferably provided at both ends of the guide recess. In particular, the recess is provided for the pivot lever to latch into the opening position in the opening guide surface, while the recess is provided for the closing position in the closing guide surface. Preferably, the carriage, in particular a lower flange of the carriage, has a corresponding recess for the pivot lever so that the ball head can engage in the ball-shell-shaped recess in a horizontal closing position of the pivot lever.

By latching and/or clamping the pivot lever at one end of the guide recess, in particular in the closed position when the pivot lever is substantially parallel to the base plate, the retaining bracket pairs can be fixed in a closed or open position and the device is secured against unintentional opening or closing, for example by application of force to the retaining bracket pairs, in particular gravity.

In an advantageous further development of the invention, the link has a mounting channel at one end of the guide recess through which the guide end of the pivot lever can be inserted into the guide recess when the carriage is mounted on the base plate. The mounting channel is preferably provided at the end of the guide recess which corresponds to the opening position, i.e. the end position of the pivot lever further away from the base plate. The mounting channel is open to the side of the pivot lever so that the guide end of the pivot lever can be threaded into the guide recess when assembling the device. The mounting channel preferably opens into the opening guide surface, runs in particular towards the base plate and is arranged in particular for engaging the guide end of the swivel head in the opening position relative to the recess.

In an advantageous further development of the invention, the device comprises a locking element located in the area between the guide recess and the mounting channel to prevent the guide end of the pivot lever from slipping out. The locking element is preferably fastened in a rear wall of the carriage, in particular in a through hole, and projects on the side of the pivot lever into the area between the guide recess and the mounting channel. The locking element is preferably designed to be detachable so that the device can be dismantled. For example, it is designed as a screwed or inserted bolt or pin made of metal or plastic. The locking element can also be fixed to the carriage after the device has been assembled, for example by gluing it in place. A detachable locking element has the advantage that the device can be maintained, in particular parts of it can be replaced and cleaned.

In an advantageous further development of the invention, the bracket connector is constructed in two parts, wherein both connector parts are connected to each other, in particular non-positively, for example by a sleeve which is non-rotatably connected to the pivot lever. Preferably, the pivot lever is designed in one piece with the sleeve but could be screwed into the sleeve as a separate part, for example. The sleeve preferably has a profiling on both sides which is adapted to the profile of the connector parts so that a positive, torsion-proof connection is created between the pivot lever and the connector parts. The connector parts can, for example, be glued or pressed into the sleeve. However, the pivot lever could also be connected to one of the two connector parts. Two of the first brackets, for example, are attached at the ends to a connector part or are designed in one piece with these. If three or four pairs of retaining brackets are provided, one or two middle first brackets may be connected to the sleeve.

In an advantageous further development of the invention, the first and second brackets have bracket ends that are formed in a straight manner. In particular, the brackets are straight on both sides from the point of closure of the pair of retaining brackets, so that in the closed state of the pair of retaining brackets a continuous straight section results, preferably over a length of 5 mm to 25 mm, further preferably from 7 mm to 20 mm, especially preferably of approximately 15 mm. The straight sections are particularly suitable for contact and latching or clamping with a fixing element, in particular a Columbus clamp, located on the inside of the front cover of a folder.

In an advantageous further development of the invention, the bracket ends of the first or second brackets have elongated bracket tips, which are in particular longer than 1 mm, preferably longer than 2 mm, further preferably longer than 3 mm, especially preferably about 4 mm long. The other bracket has correspondingly deep recesses into which the bracket tips engage in the closed state of a pair of retaining brackets. Elongated bracket tips have the advantage that the first and second brackets are better guided when closing the pairs of retaining brackets and thus mesh reliably, even when the brackets are subjected to high loads.

In an advantageous further development of the invention, the base plate has at least one bearing section for the bearing of the bracket connector, wherein the bearing section is formed integrally with the base plate. Preferably, the base plate surrounds the bracket connector, for example with a wall thickness of about 2 mm. In the bearing sections of the base plate, bearing bushes, preferably made of metal, can be arranged, in particular cast in, for the bearing of the web of the bracket, in particular two bearing bushes for the bearing of a web part in each case.

In an advantageous further development of the invention, the device comprises two, three or four pairs of retaining brackets. This has the advantage that the device can be used to receive punched sheets which are perforated according to the various international standard perforation systems, in particular for double, triple or quadruple perforation. The pairs of retaining brackets are spaced according to the underlying perforation standard, for example 21 mm, 70 mm or 108 mm, but preferably 80 mm, wherein the distances between the pairs of retaining brackets may be different. The base plate, in particular its dimensions and shape, as well as the bracket connector, and preferably the sleeve, are adapted to the number of pairs of retaining brackets. The base plate may have further bearing sections for bearing the bracket connector. The link and the pivot lever are preferably of the same design regardless of the number of retaining bracket pairs.

In addition, the object is solved in particular by a folder, in particular an erectable ring binder, comprising a front cover and a rear cover, a spine connecting the two covers and a device according to the invention for accommodating punched sheets.

In an advantageous further development of the folder according to the invention, a fixing device is arranged on the inside of the front cover, which fixing device fixes at least one pair of retaining brackets in a folded state of the folder, in that at least one fixing element fixes the bracket ends of the first and/or second brackets relative to one another, preferably in a straight region of the bracket ends. In particular, one or more fixing elements act on the straight areas of the bracket ends in order to fix them in such a way that an opening of the closed pair of retaining brackets is prevented. By fixing in the straight area of the bracket ends, the contact area accessible for the fixing device between the first and second brackets and the fixing device is increased so that a better fixing is possible than would be possible in curved areas of the brackets or with curved bracket ends. The fixing device, for example, is designed as a clamping device, in particular a Columbus clamp, which clamps either one or both ends of the bracket. However, the fixing device can also be designed as a latching device into which the ends of the brackets latch when the folder is closed. The fixing device is fastened to the inside of the front cover, for example by gluing or riveting. The advantage of such a fixing device is that the bracket ends of the retaining bracket pairs are fixed in addition to the closing force applied by the device itself for accommodating the sheets, so that the retaining bracket pairs do not open unintentionally, even in the event of large forces, e.g. when a folder with a stack of inserted sheets falls to the floor. In addition, an erected folder with a fixing device is more stable.

In an advantageous further development of the folder according to the invention, a fixing element is provided for a pair of retaining brackets, which fixes both ends of the retaining bracket pair in an overlapping manner. In particular, the fixing element projects above the closure point of the pair of retaining brackets at which the ends of the first and second brackets meet. Accordingly, the fixing element is, in particular, a common fixing element for both bracket ends of a pair of retaining brackets. This allows the fixing element to securely fix both ends of the bracket at the same time, in particular to partially enclose them, preferably with a frictional connection. The fixing element is preferably designed as a wedge-shaped latching element, in particular made of rubber or plastic. In particular, the latching element is beveled in such a way that the front cover of the folder is held parallel to the rear cover after it has been latched into the straight sections of the first and second brackets. This allows the relative movement of both ends of the bracket to be prevented in a simple and safe manner and the folder can be set up so that it cannot tip over.

In an advantageous further development of the folder according to the invention, the fixing device has two fixing elements to fix two pairs of retaining brackets. Even in the case of a folder with a device for accommodating punched sheets with three or four pairs of retaining brackets, the fixing device preferably has only two fixing elements in order to fix two pairs of retaining brackets. The distance and position of the two fixing elements may be adjusted to the distance and position of the retaining bracket pairs.

In an advantageous further development of the folder according to the invention, the fixing device comprises a receiving device for a data storage unit. Such a receiving device can be designed as a recess in a base body of the fixing device. A data storage unit may be housed in a fixing device to store and read data that may be associated with the contents of the folder. This can be done via a port for a PC, especially a USB port, or a wireless connection. In addition, the fixing device may include a display holder for displaying and browsing the contents of data memory. The display can also be mounted as a separate component on any part of the shell.

In an advantageous further development of the folder according to the invention, the front cover and/or the rear cover has a closure flap, which, together with the front cover, rear cover and back, forms a cover of the folder and can be detachably fixed, preferably by magnets. The magnets can, for example, be designed as flat point magnets. A cover has the advantage that the contents of the folder are protected.

In an advantageous further development of the folder according to the invention, the folder has a carrying strap. The carrying strap is preferably attached to the folder cover and is especially designed in the form of a shoulder strap. This makes it easier for a user to transport the folder.

A further aspect of the invention relates to a manufacturing process for a device for accommodating loose sheets, in particular a previously described device according to the invention, comprising the following steps:

Providing at least two pairs of retaining brackets, a carriage with a link and a pivot lever, wherein the pairs of retaining brackets each comprise a first and a second bracket and at least two of the first brackets are connected each to a connector part of a bracket connector;

Producing a base plate, preferably by die-casting, in particular from fiber-reinforced plastic, wherein the foot ends of the second bracket are cast into the base plate and bearing sections for the bearing of the connector parts are formed integrally with the base plate;

Inserting the connector parts into the bearing sections provided for this purpose;

Connecting the connector parts to form a bracket connector which is mounted in the bearing sections so as to be rotatable about an axis of rotation parallel to the base plate, wherein the pivot lever is connected to the bracket connector;

Mounting a carriage on the base plate in such a way that it is displaceably mounted, wherein the pivot lever is inserted into the link.

In an advantageous further development of this aspect of the invention, a guide end of the pivot lever is inserted through a mounting channel provided in the link into a recess guide of the link, in particular a guide slot or guide groove.

In an advantageous further development of this aspect of the invention, bearing bushings, preferably made of metal, are cast into the bearing sections of the base plate during the manufacture of the base plate.

In an advantageous further development of this aspect of the invention, guide pins are formed on the base plate for bearing the carriage during the manufacture of the base plate.

Embodiment examples of the invention are explained in more detail below by reference to the drawings, wherein:

FIG. 1*a* shows a schematic representation of an embodiment of a device according to the invention having two pairs of retaining brackets in the open state in an axonometric view;

FIG. 1*b* shows a schematic representation of an embodiment of a device according to the invention having two pairs of retaining brackets in the closed state in an axonometric view;

FIG. 2*a* shows a schematic representation of an embodiment of a device according to the invention having two pairs of retaining brackets in the open state in a front view;

FIG. 2*b* shows a schematic representation of an embodiment of a device according to the invention having two pairs of retaining brackets in the closed state in a front view;

FIG. 3*a* shows a schematic representation of an embodiment of an device according to the invention having two pairs of retaining brackets in the open state in a sectional side view;

FIG. 3*b* shows a schematic representation of an embodiment of a device according to the invention having two pairs of retaining brackets in the closed state in a sectional side view;

FIG. 4*a* shows a schematic representation of an embodiment of the carriage of the device according to the invention in a front view;

FIG. 4*b* shows a schematic representation of an embodiment of the carriage of the device according to the invention in a rear view having a sectional progression Y-Y;

FIG. 4*c* shows a schematic representation of an embodiment of the carriage of the device according to the invention and according to FIG. 4*b* in a sectional plan view along the sectional progression Y-Y;

FIG. 5*a* shows a schematic representation of an embodiment of the link of the device according to the invention in a detailed axonometric view from the front left;

FIG. 5*b* shows a schematic representation of an embodiment of the link of the device according to the invention in a detailed axonometric view from the front right;

Figure 8A:
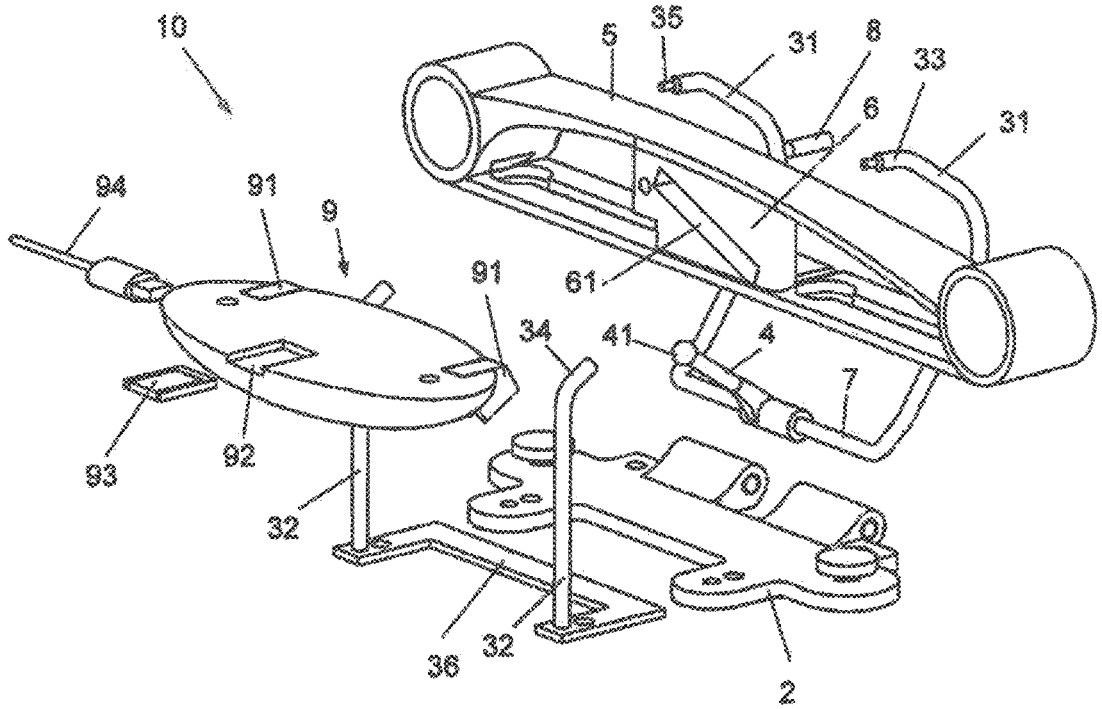
Figure 8B:
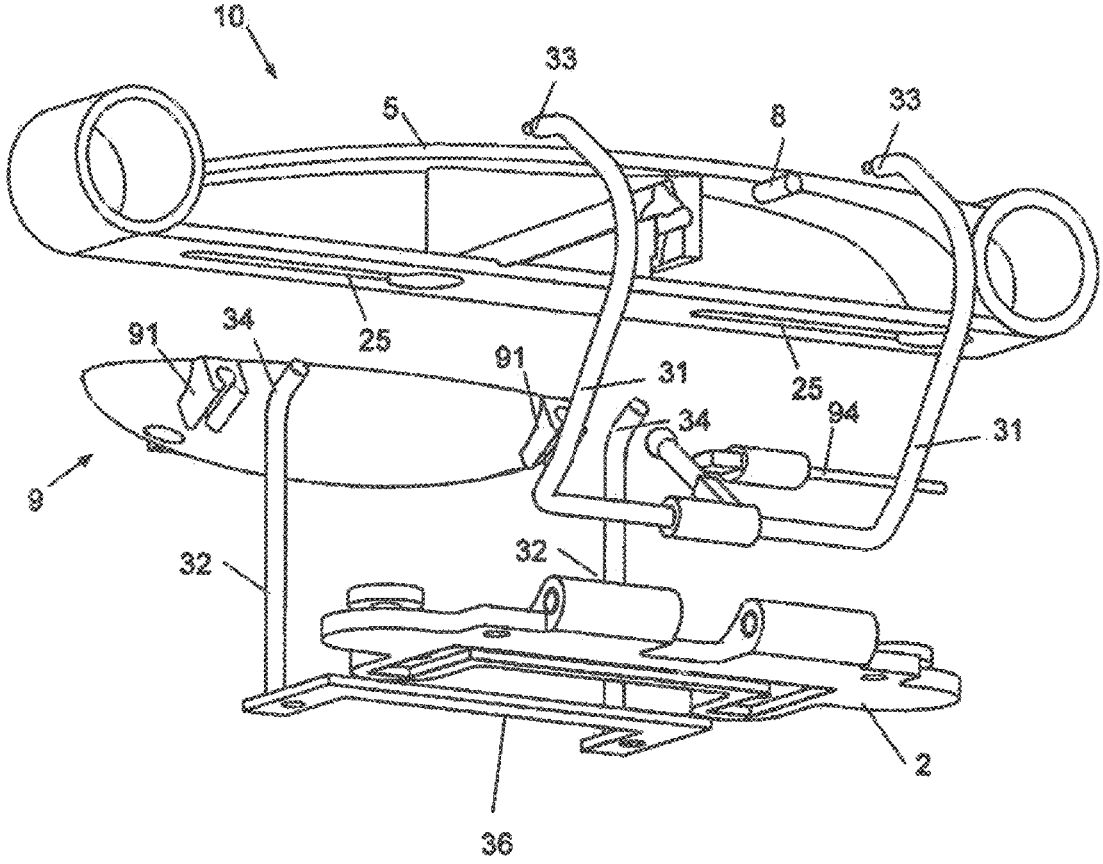
Figure 9:
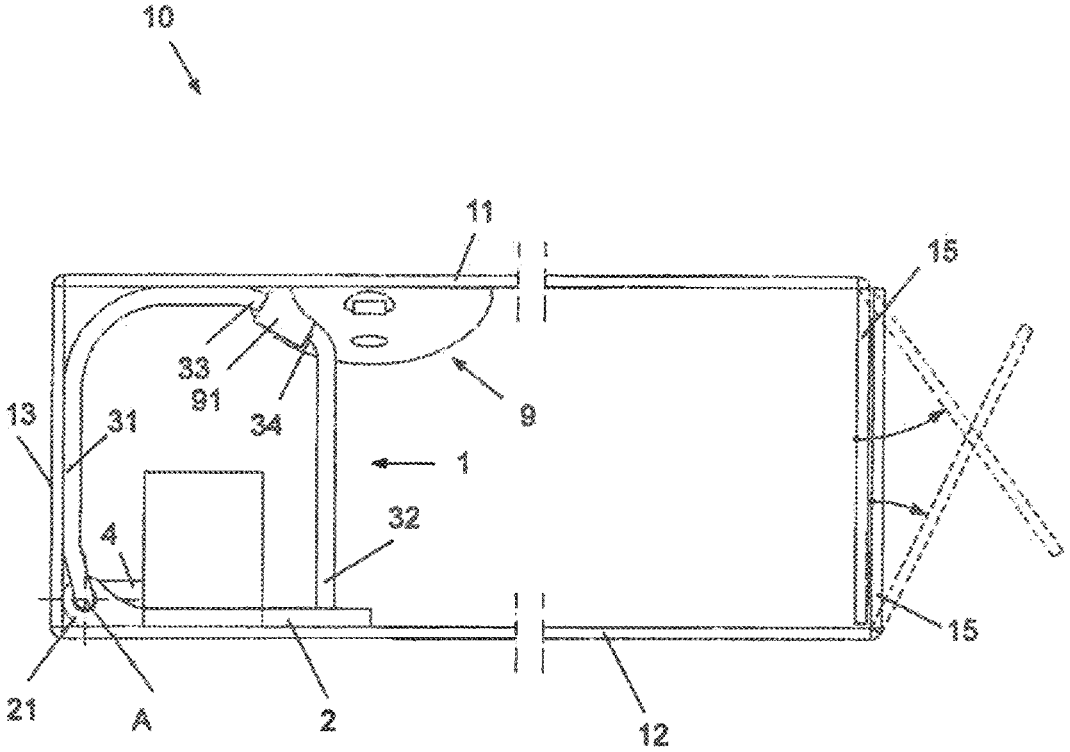
Figure 10:
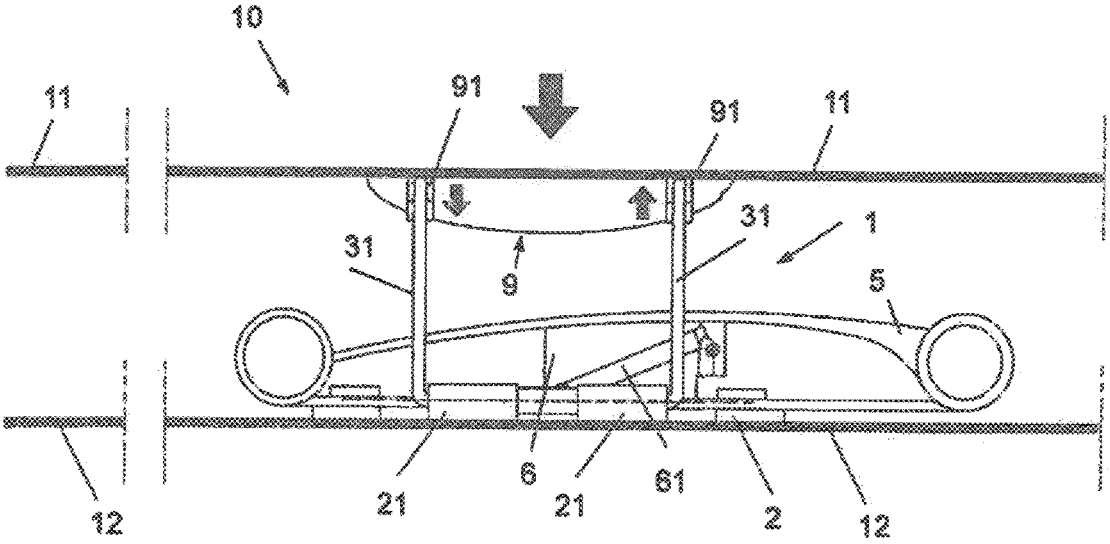
Figure 11A:
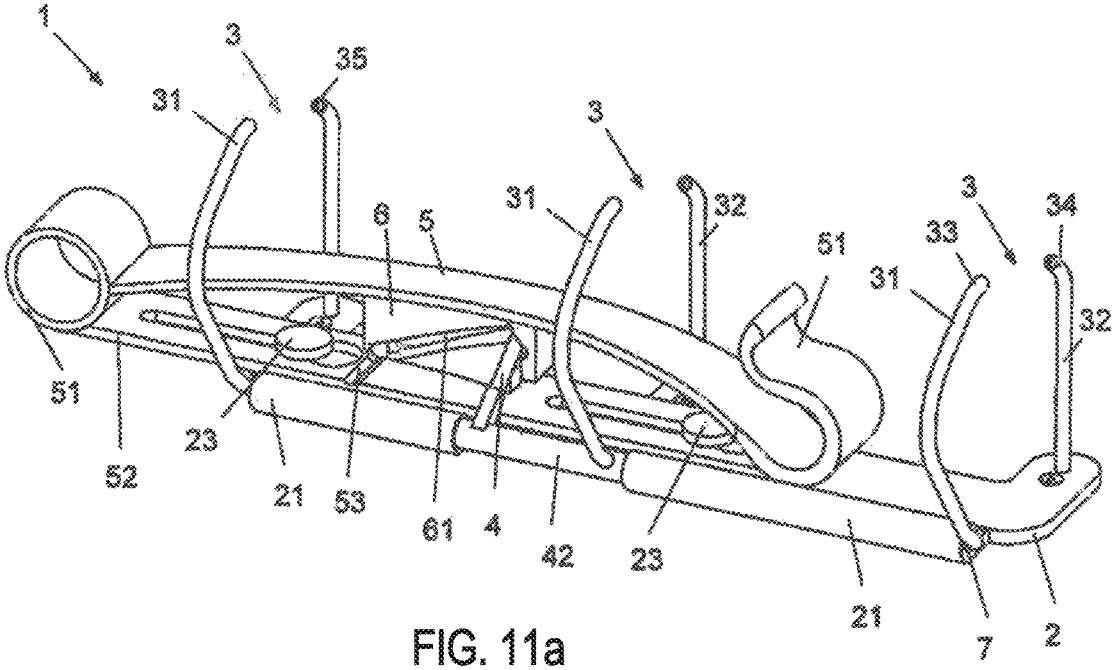
Figure 11B:
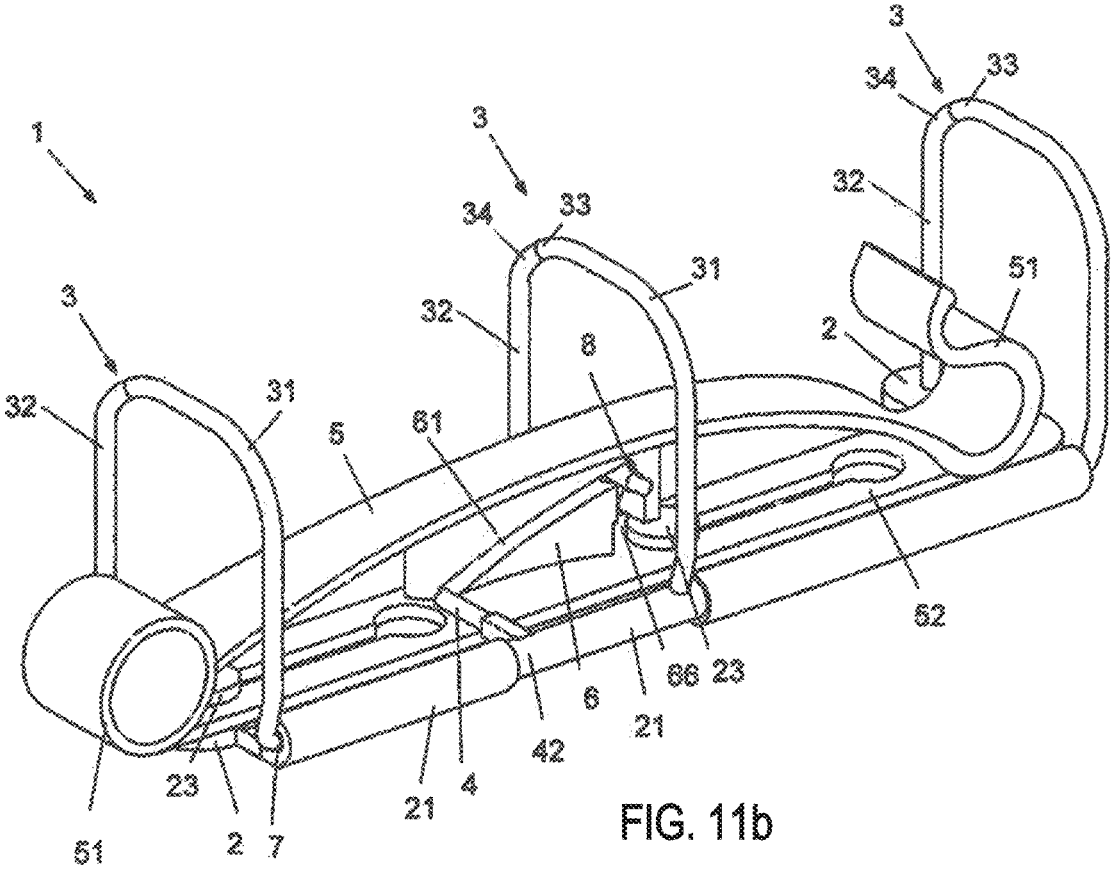
Figure 12A:
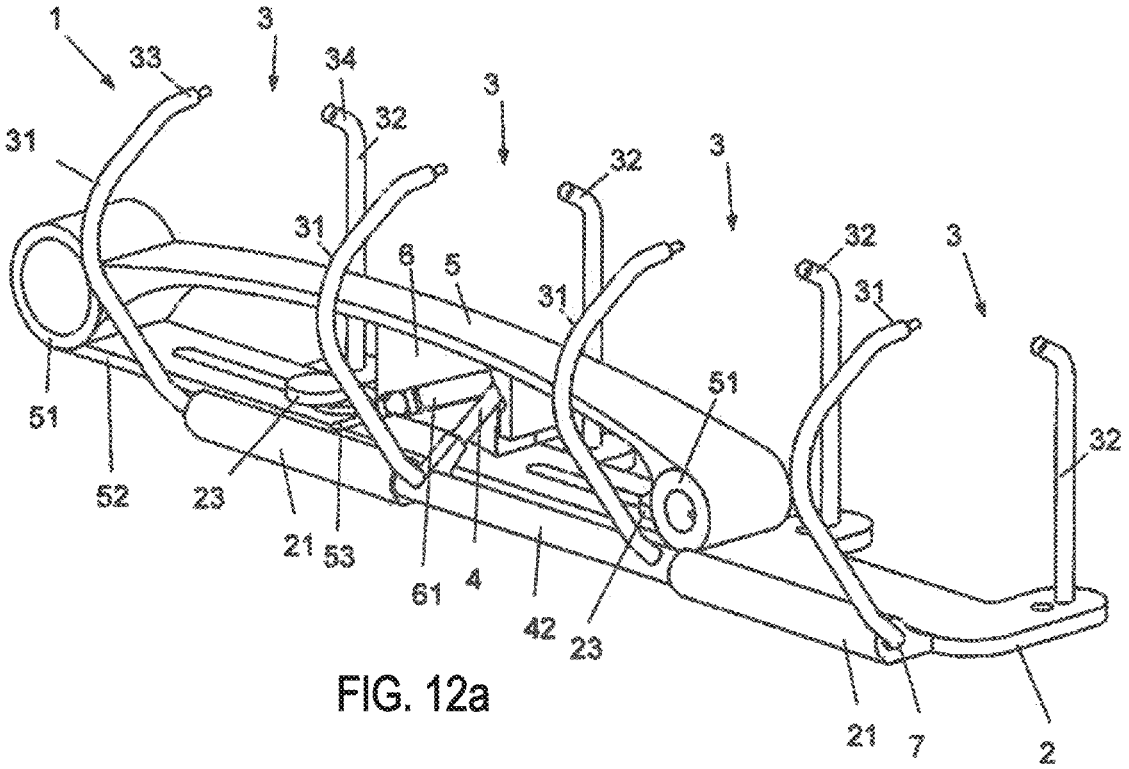
Figure 12B:
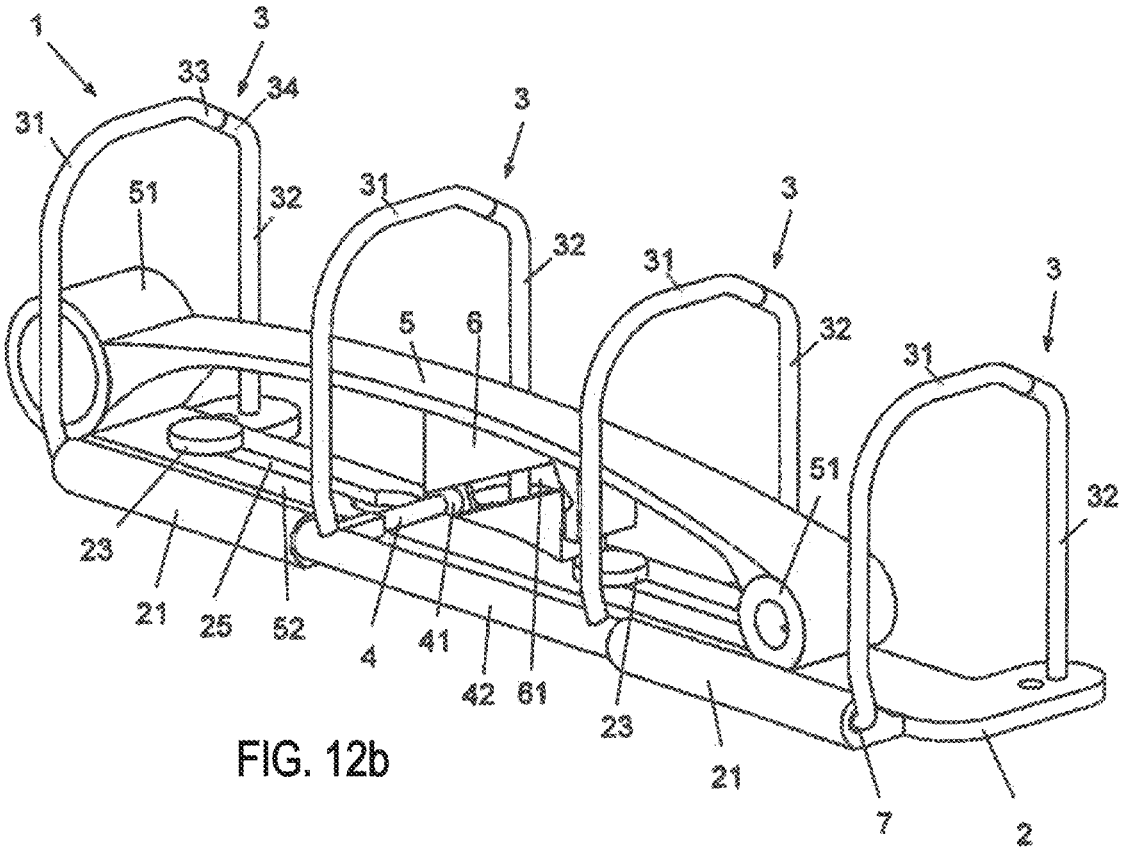

FIG. 8*a* shows a schematic representation of an embodiment of a device having two pairs of retaining brackets and a fixing device of a folder according to the invention in an axonometric exploded view from the rear right;

FIG. 8*b* shows a schematic representation of an embodiment of a device having two pairs of retaining brackets and a fixing device of a folder according to the invention in an axonometric explosion view from the front bottom left;

FIG. 9 shows a schematic representation of an embodiment of a folder according to the invention in the closed state in a detailed side view;

FIG. 10 shows a schematic representation of an embodiment of a folder according to the invention in the closed state in a front view;

FIG. 11*a* shows a schematic representation of an embodiment of a device according to the invention having three pairs of retaining brackets in the open state in an axonometric view;

FIG. 11*b* shows a schematic representation of an embodiment of a device according to the invention having three pairs of retaining brackets in the closed state in an axonometric view;

FIG. 12*a* shows a schematic representation of an embodiment of a device according to the invention having four pairs of retaining brackets in the open state in an axonometric view;

FIG. 12*b* shows a schematic representation of an embodiment of a device according to the invention having four pairs of retaining brackets in the closed state in an axonometric view;

In the following part of the description of the invention, the same reference numerals are used for identical and equivalent elements.

Figure 1A:
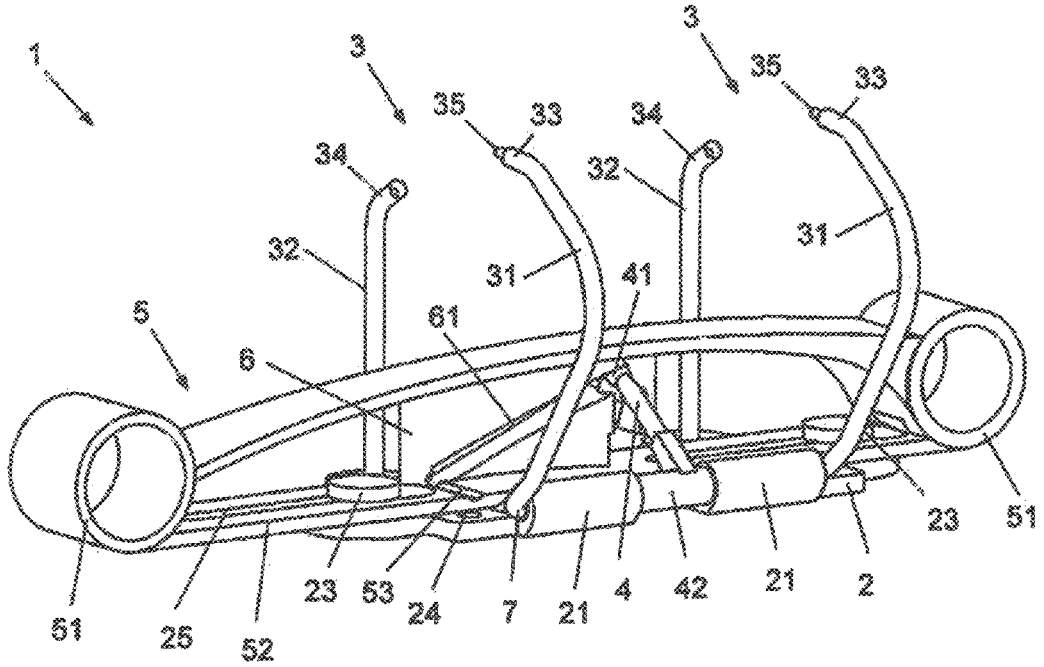
Figure 1B:
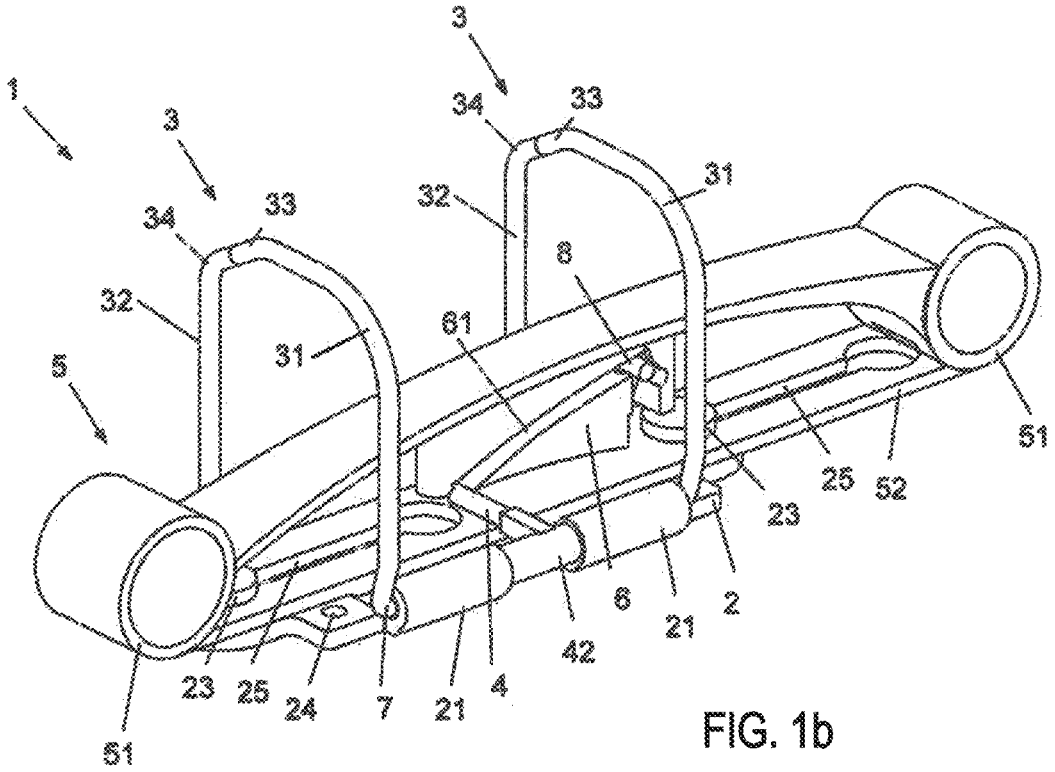
Figure 2A:
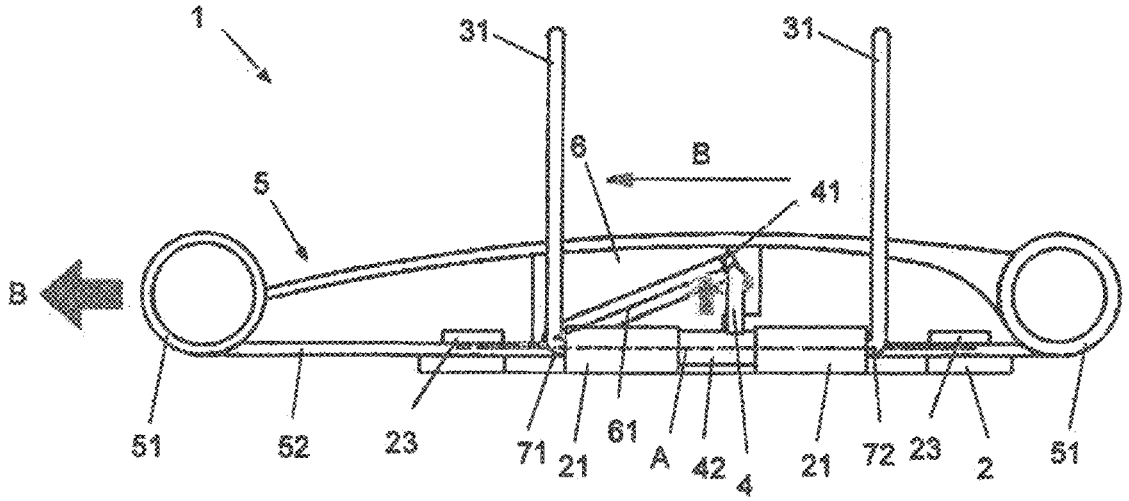
Figure 2B:
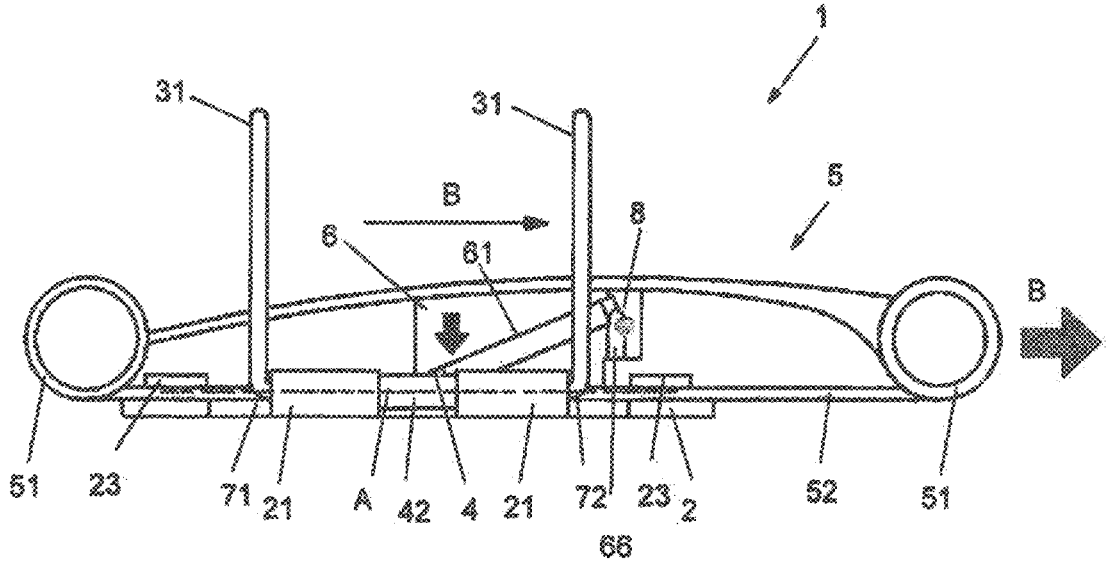
Figure 3A:
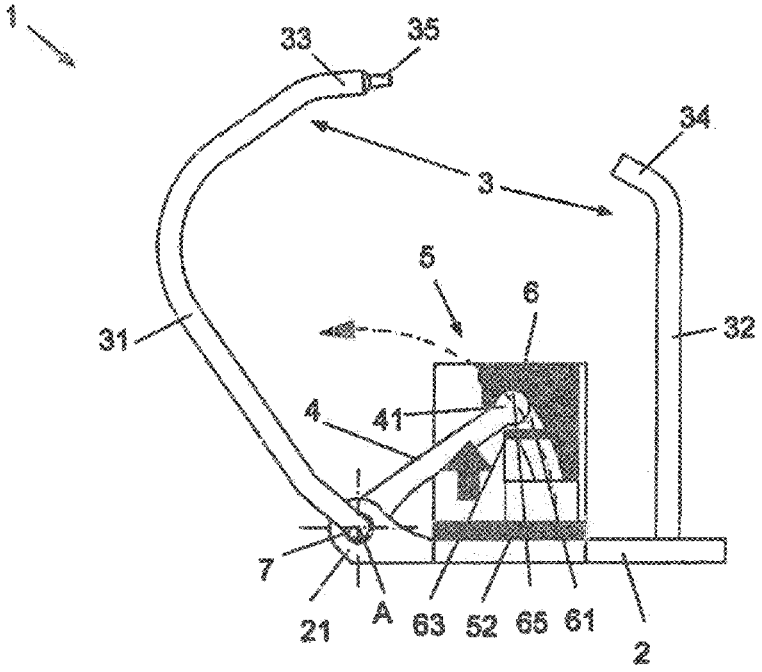

FIGS. 1*a*, 1*b*, 2*a*, 2*b*, 3*a*, 3*b* and 6 show a device 1 for accommodating punched sheets, in particular of paper, paperboard, cardboard or plastic, having two pairs of retaining brackets 3. FIGS. 1*a*, 2*a* and 3*a* show this device 1 in an open state and FIGS. 1*b*, 2*b* and 3*b* in a closed state.

Each pair of retaining brackets 3 comprises a first bracket 31 and a second bracket 32, which can be closed to form a continuous retaining bracket, as shown in FIG. 1*b*. In this way, in the open state, as shown in FIG. 1*a*, punched sheets (not shown) inserted into device 1, which are threaded with their holes onto the first or second brackets 31, 32 and lined up by these as an orderly stack of sheets, can be turned from one side of device 1 to the other side. When device 1 is open, sheets can be inserted or removed. The first and second brackets 31, 32 are typically made of 4 mm thick metal rods and have straight bracket ends 33, 34. At the first bracket ends 33, elongated bracket tips 35 continue, which are approximately 4 mm long, for example, and which, when the pair of holding brackets is closed, engage in correspondingly formed recesses in the second bracket ends 34.

The device 1 has a base plate 2, which can be arranged, for example, on the inside of a back cover 12 of a folder, in particular fixed thereto, for which purpose the base plate has 2 through holes 24 for rivets or screws. On the base plate 2, a carriage 5 is displaceably mounted so that it can be manually moved along its longitudinal direction relative to the base plate 2 between the pairs of brackets 3 in the direction of movement B. For this purpose, the carriage 5 has on both longitudinal sides a handle 51, in particular a handle 51 which is dimensioned in particular for the engagement of a human finger and may also be shaped, for example, as an open loop, bow or other handle. The carriage 5 is slidably guided on both sides along longitudinal slots 25 in a bottom flange 52 of the carriage 5 on guide pins 22 on the base plate 2 and is held in a vertical direction to the base plate 2 by widened, flat round heads 23 of the guide pins 22. The guide pins 22 are preferably made integrally with the base plate 2 but could also be screwed or glued into the base plate. The carriage 5 is designed as an arched frame but could also be solid or with a central wall when adjusting the pivot guide.

Two bearing sections 21 are formed integrally with the base plate 2 and support a bracket connector 7 rotatable around a rotation axis A, which runs parallel to the base plate 2. The first brackets 31 are firmly connected to the bracket connector 7. In particular, the first brackets 31 are formed integrally, each with a connector part 71 or 72, which are inserted into the bearing sections 21 on both sides and mounted in them. The connector parts 71 and 72 are force-locked to each other via a sleeve 42 to form the bracket connector 7. The bracket connector 7 is connected to a pivot lever 4, which is preferably made in one piece with the sleeve 42 but can also be attached as a separate part to the sleeve 42 or directly to the bracket connector 7.

The rod-shaped pivot lever 4 projects at a right angle from the bracket connector 7 or the axis of rotation A in the direction of the carriage 5. At its free end, which serves as guide end 41, the pivot lever 4 forms a ball head. The geometry of the guide end 41 can also be a hemisphere, cylinder journal, block or an angled extension shaped in this way. The pivot lever 4 is preferably rigid but can also be designed with several links, in particular two links with a connecting joint, in order to be tiltable in the direction of the base plate 2 in relation to a link 6.

The carriage 5 has a link 6 with a guide recess 61, which is designed here as a guide slot open on both sides but could also be designed as a guide groove open on one side towards the lever 4. The guide recess 61 extends in the longitudinal direction of the carriage 5 obliquely to the base plate 2 and has a straight course in a longitudinal section of the carriage 5. The pivot lever 4 engages with the guide end 41, here the ball head, in the guide recess 61, so that the link 6 forms a link guide with the pivot lever 4. The guide end 41 of the pivot lever 4 is slidably guided in the guide recess 61 along guide surfaces, namely a closing guide surface 62 and an opening guide surface 63, on both sides, wherein the link guide may have a small play. Displacing the carriage 5 in one direction (in FIGS. 1*a* and 2*a* to the left) causes the pivot lever 4 to be pushed upwards from the opening guide surface 63 in the link 6 away from the base plate 2 and the retaining bracket pairs 3 to open, as shown by arrows in FIG. 2*a*. An opposite displacement of the carriage 5 (in FIGS. 1*b* and 2*b* to the right) causes the pivot lever 4 to be pressed downwards from the closing guide surface 62 in the link to the base plate 2 and the retaining bracket pairs 3 to close as shown by arrows in FIG. 2*b*. In this way, the link 6 determines the rotary movement of the lever 4 in both directions of rotation about the axis of rotation A.

In one end position (see e.g. FIGS. 1*a*, 2*a*, 3*a*, 11*a*, 12*a*), the pivot lever 4 is in an opening position at a maximum achievable angle to the base plate 2 at one end of the guide recess 61 and the retaining bracket pairs 3 are open. In a second end position (see e.g. FIGS. 1*b*, 2*b*, 3*b*, 9, 10, 11*b*, 12*b*) the pivot lever 4 is in a closed position at a minimum achievable angle to the base plate 2 at the other end of the guide recess 61 and the retaining bracket pairs 3 are closed.

Figure 3B:
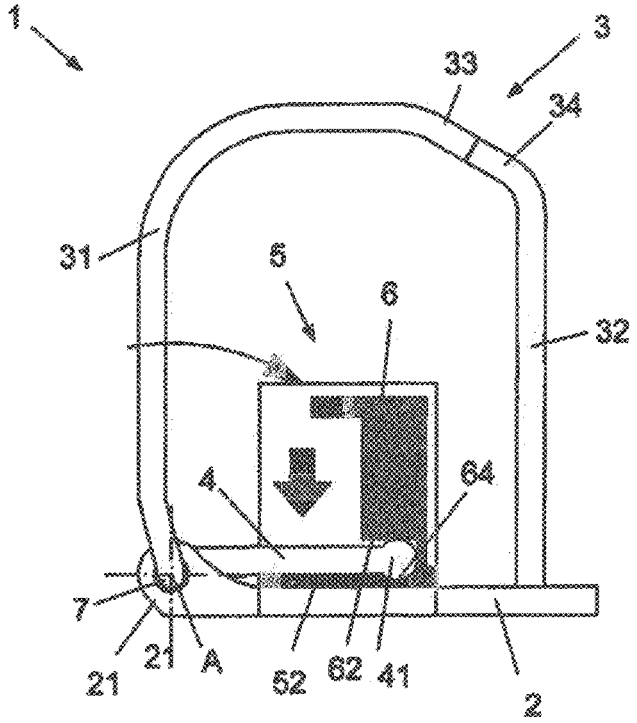

In FIGS. 3*a* and 3*b* the link 6 is shown in a sectional view (blackened). Latching elements are provided at both ends of the guide recess 61 which fix the pivot lever 4 in the respective position in a detachable manner. The latching element is designed in each case as a ball-shell-shaped recess 64 or 65, into which the guide end 41 of the pivot lever 4, designed as a ball head, is latched. The opening guide surface 63 presses the pivot lever 4 into the recess 65 when the retaining bracket pairs 3 are open. A corresponding recess 53 for the pivot lever 4 is formed in the bottom flange 52 (see FIG. 1*a*, for example) so that said lever can come into a lying position parallel to the base plate 2. The closing guide surface 62 pushes the pivot lever 4 into the recess 64 when the retaining bracket pairs 3 are in a closed state. The guide surfaces 62, 63 are wider than the diameter of the ball head, wherein the closing guide surface 62 projects laterally, i.e. towards the pivot lever 4, over the opening guide surface 63. This allows the pivot lever 4 to be positioned unhindered, while it is guided along the link 6 with increasing angle to the base plate 2, without tilting in the guide recess 61. At the same time, it is ensured that the pivot lever does not slip out of the guide recess 61 even when the link guide is heavily loaded.

Figure 4A:
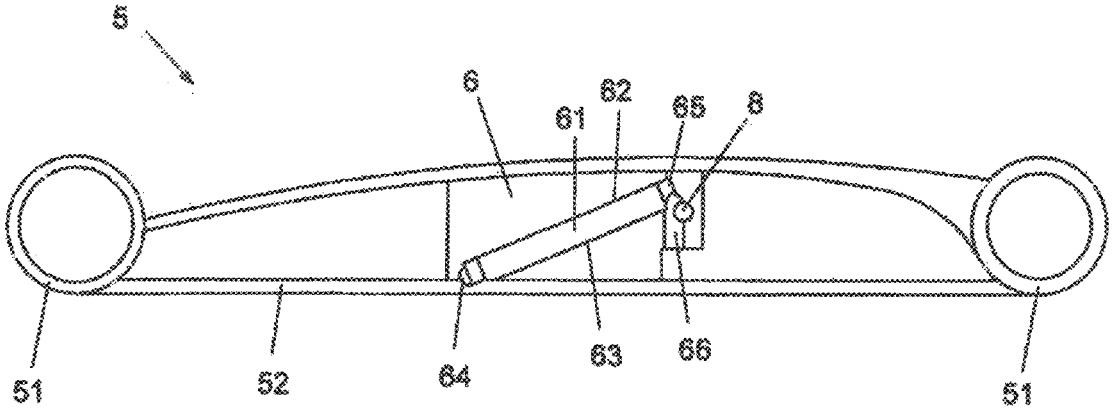
Figure 4B:
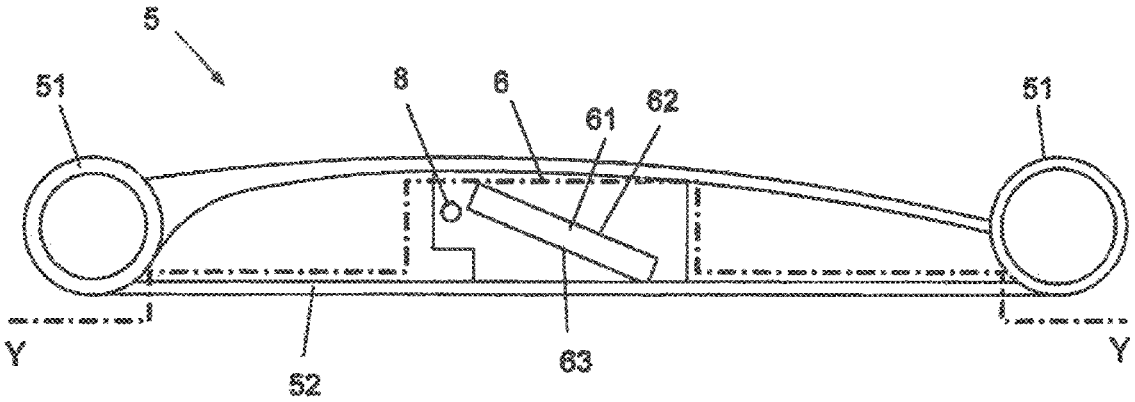

FIGS. 4*a* and 4*b* show carriage 5 with the link 6 having a guide recess 61 open on both sides of carriage 5. At the end of the guide recess 61, which corresponds to the opening position of the pivot lever 4, there is a mounting channel 66, which allows the guide end 41 of the pivot lever 4 to be inserted or threaded from the base plate 2 into the guide recess 61 during assembly of the device 1. The mounting channel 66 is open to the side of the pivot lever 4. A locking element 8 in the form of a cylindrical pin is arranged in the area between the guide recess 61 and the mounting channel 66 in a through hole 67 to block the mounting channel 66 and prevent the lever 4 from slipping out of the guide recess 61.

Figure 4C:
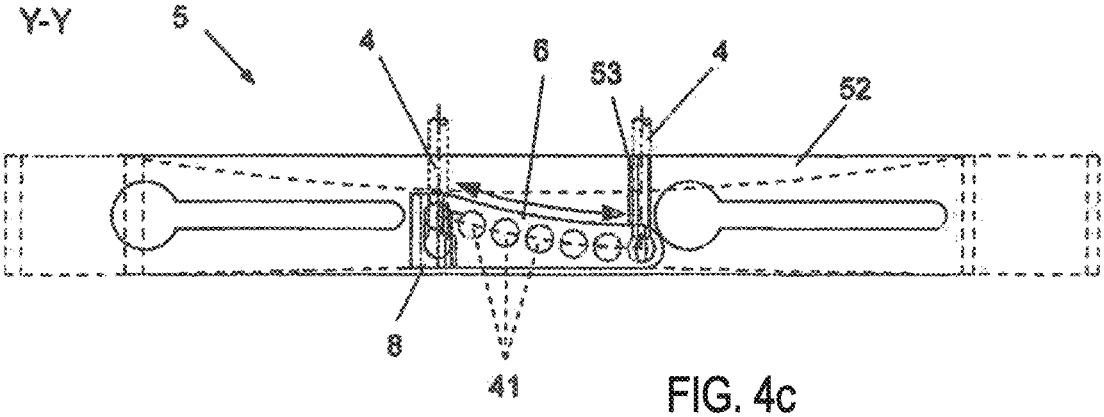

FIG. 4*c* shows the link 6 in a sectional plan view of carriage 5. The link 6 has a wedge-shaped basic body which widens in the direction of the opening position of the pivot lever. The two end positions of the pivot lever 4 and some intermediate positions of the ball head, which moves in a vertical projection on the base plate 2 with increasing angle of rotation of the pivot lever 4 on an arc path (see double arrow), are schematically indicated (dashed). The shape of the link 6 is adapted to this path of the guide end 41 of the pivot lever 4 in displacement direction B of the carriage. In this way it can be prevented that the pivot lever 4 slips out of the guide recess 61 with increasing opening of the retaining bracket pairs 3.

Figure 5A:
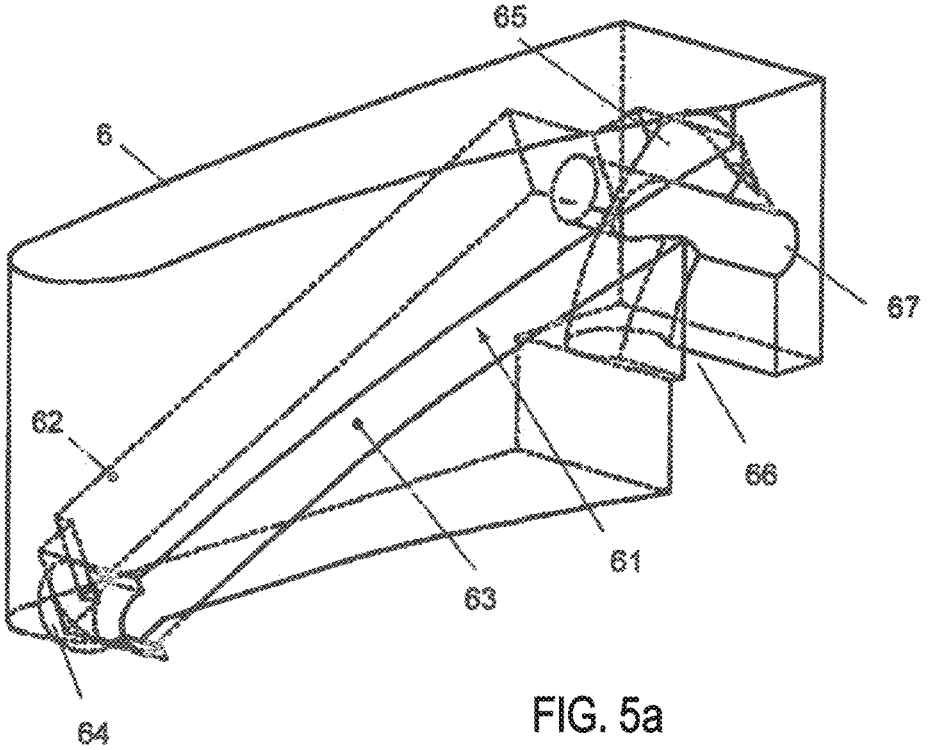
Figure 5B:
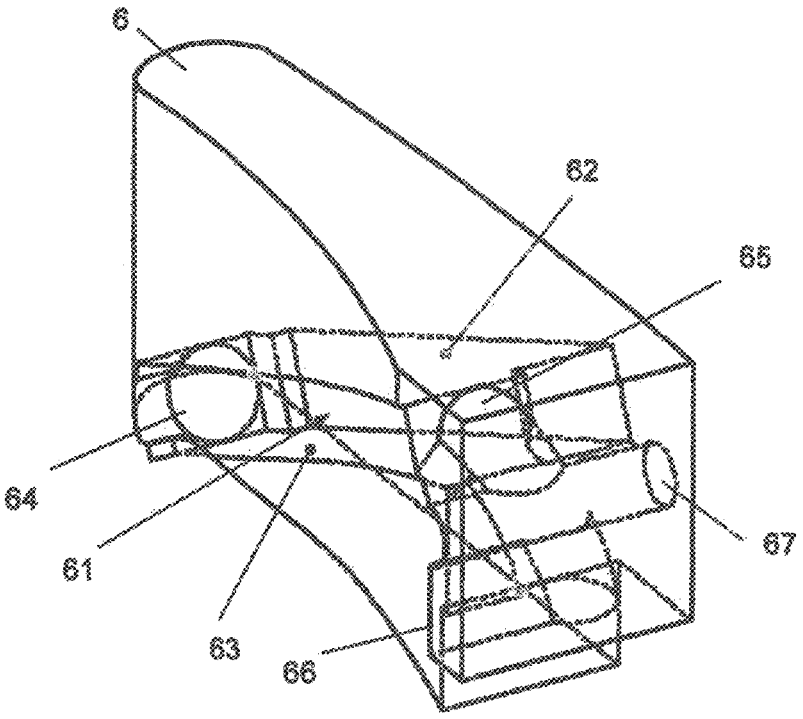

FIGS. 5*a* and 5*b* show an exposed detailed view of link 6, in which the through hole 67 for the locking element 8, the guide recess 61, the mounting channel 66 and the end recesses 64 and 65 can be seen in the opening guide surface 63 or the closing guide surface 62 for latching the pivot lever 4.

Figure 6:
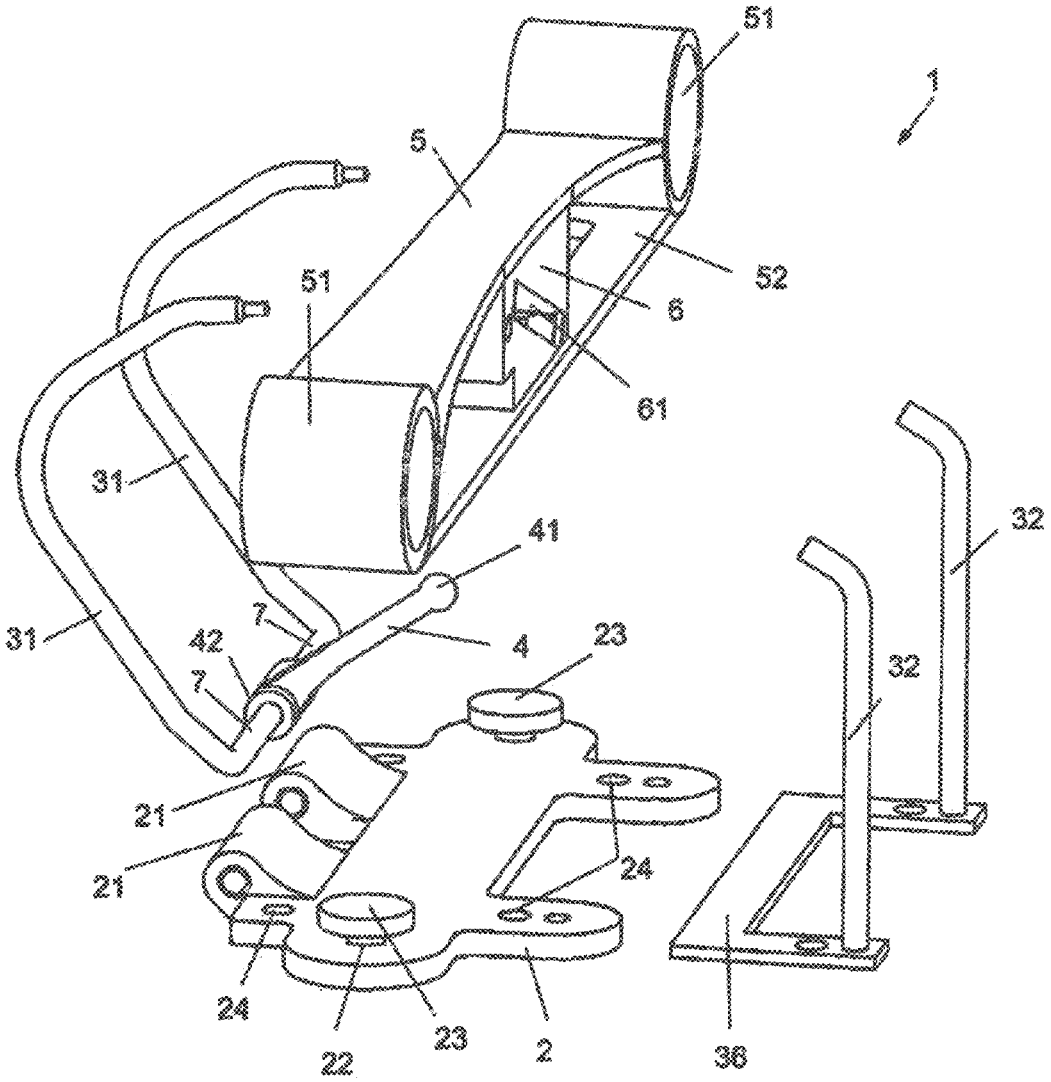
FIG. 6 shows a schematic representation of an embodiment of a device according to the invention with two pairs of retaining brackets in an axonometric exploded view.

FIG. 6 shows the device with two pairs of retaining brackets 3 in an exploded view, wherein the second brackets 32 are connected to one another via a carrier plate 36, in particular made of metal. The carrier plate 36 is preferably cast into the base plate 2, wherein said carrier plate determines the distance and position of the second bracket 32 during casting. The carrier plate 36 can also be inserted into a corresponding recess on the underside of the base plate 2, wherein the second brackets 32 are inserted through through holes in the base plate 2.

Figure 7:
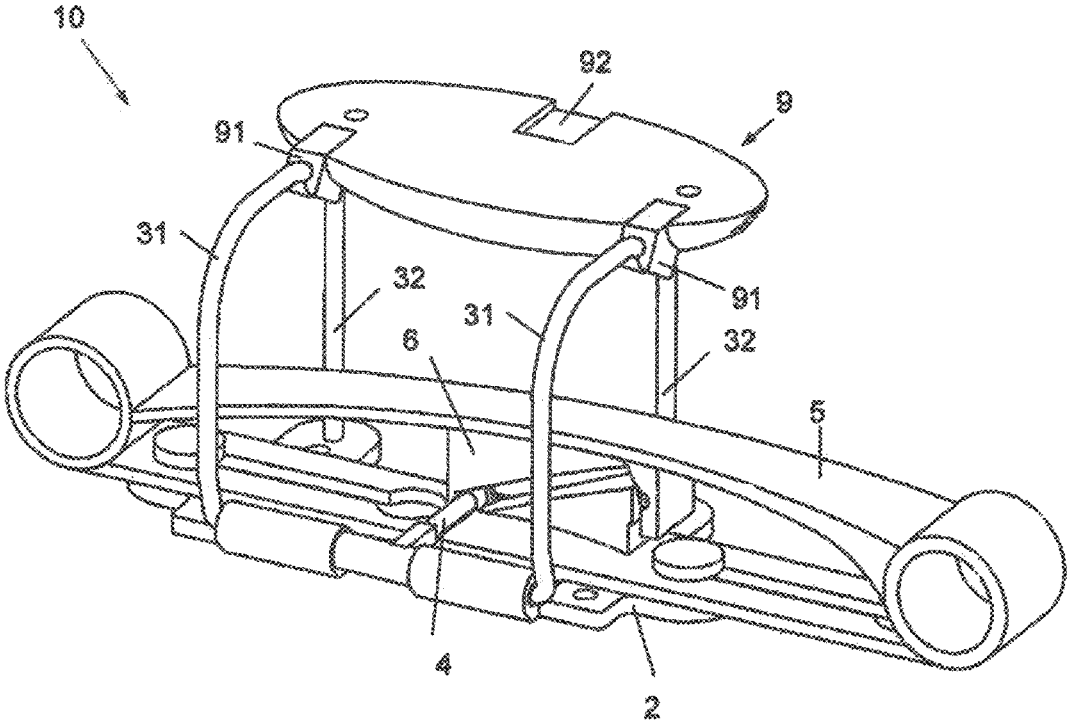
FIG. 7 shows a schematic representation of an embodiment of a device having two pairs of retaining brackets in the closed state and a fixing device of a folder according to the invention in an axonometric view.

FIG. 7 shows a device 1 with two pairs of retaining brackets 3 in the closed state and a fixing device 9 of a folder according to the invention (not shown). The fixing device 9 acts with fixing elements 91, which are designed as wedge-shaped beveled latching elements, preferably made of rubber, on the straight bracket ends 33, 34 of the first and second brackets 31, 32, in order to fix them relative to each other. The fixing elements 91 engage over the closing point between the first and second brackets 31, 32.

FIGS. 8*a* and 8*b* show device 1 according to FIG. 7 with two pairs of retaining brackets 3 and a fixing device 9 with two latching elements 91 in axonometric exploded views. The fixing device 9 has a receiving device 92 for a data storage unit 93, in particular an interchangeable one, and a connection for a cable 94 for reading and storing data.

FIGS. 9 and 10 show a folder 10 according to the invention, in particular a folder, having a front cover 11, a rear cover 12 and a spine 13 connecting the two covers 11, 12, wherein a device 1 according to the invention is arranged on the inside of the rear cover 12 and a fixing device 9 on the inside of the front cover 11. The front cover 11 and the rear cover 12 are adjoined by overlapping closing flaps 15, which allow the folder 10 to be closed and give it better stability. The movement of the closing flaps 15 is indicated by arrows in FIG. 9. As explained in connection with FIG. 7, the fixing device 9 fixes the retaining bracket pairs 3 in each case with one fixing element 91 by engaging over the two bracket ends 33, FIGS. 11*a* and 11*b* show an embodiment of a device 1 for accommodating punched sheets, in particular of paper, paperboard, cardboard or plastic, having three pairs of retaining brackets 3.

FIGS. 12*a* and 12*b* show an embodiment of a device 1 for accommodating punched sheets, in particular paper, paperboard, cardboard or plastic, having four pairs of retaining brackets 3.

The representations and descriptions in and relating to FIGS. 3*a*, 3*b*, 4*a*, 4*b*, 4*c*, 5*a* and 5*b* also relate to the embodiment according to FIGS. 11*a* and 11*b* as well as to the embodiment according to FIGS. 12*a* and 12*b*, wherein the geometry of the carriage 5 and a handle 51 are designed differently. The descriptions in connection with the FIGS. 1*a*, 1*b*, 2*a*, 2*b*, 6, 7, 8*a*, 8*b*, 9 and 10 shall apply mutatis mutandis to these embodiments. The dimensions of the base plate 2 and the connection between the first brackets 31 and the bracket connector 7 or sleeve 42 are adjusted accordingly but functionally the same as for the embodiment with two pairs of retaining brackets 3.

At this point, it should be noted that all the parts described above are claimed separately and in each combination, in particular the details depicted in the drawings, to be essential for the invention. The person skilled in the art is familiar with modifications made thereto.

LIST OF REFERENCE NUMERALS

1 Device
2 Base plate
3 Pair of retaining brackets

4 Pivot lever
5 Carriage
6 Link
7 Bracket connector
8 Locking element
9 Fixing device
10 Folder
11 Front cover
12 Rear cover
13 Spine
14 Inside
15 Closing flap
21 Bearing section
22 Guide pin
23 Round head
24 Through hole
25 Longitudinal slot
31 First bracket
32 Second bracket
33 Bracket end
34 Bracket end
35 Bracket tip
36 Carrier plate
41 Guide end
42 Sleeve
51 Handle
52 Bottom flange
53 Recess
61 Guide recess
62 Closing guide surface
63 Opening guide surface
64 Recess
65 Recess
66 Mounting channel
67 Through hole
71 Connector part
72 Connector part
91 Fixing element
92 Receiving device
93 Data storage device
94 Cable
A Axis of rotation
B Displacement direction

The invention claimed is:

1. A device for accommodating punched sheets, comprising:

one base plate, at least two pairs of retaining brackets which are designed to be openable and closeable and each have a first bracket and a second bracket, wherein the at least two first brackets are connected to one another via a bracket connector which is connected to the base plate so as to be rotatable about an axis of rotation extending parallel to the base plate and is connected to a pivot lever, and a carriage which is displaceably mounted on the base plate, wherein the carriage has a link including a guide recess, wherein the link guides the pivot lever and is configured such that, when the carriage is displaced, the link determines a rotational movement of the pivot lever about the axis of rotation parallel to the base plate in both directions of rotation, wherein the pivot lever has a guide end which engages in the guide recess, wherein the guide end is formed by a free end of the pivot lever and an other end is firmly connected to the bracket connector, wherein the guide recess is delimited by guide surfaces comprising a closing guide surface and an opening guide surface, which cause said pairs of retaining brackets to close and open, respectively, by the guide end of the pivot lever being in contact with the closing guide surface or the opening guide surface, respectively, during the respective movement of the pairs of retaining brackets, wherein, in a sectional plane of the link parallel to the base plate, the guide recess is adapted to the path of the guide end of the pivot lever in an arcuate manner; and wherein the link has latching or clamping elements at at least one end of the guide recess for releasably fixing the pivot lever in an end position.

2. The device according to claim 1, wherein the guide recess includes a guide slot which is open on both sides, or a guide groove open on one side, or a guide rail.

3. The device according to claim 2, wherein the guide recess is designed to be straight in a section plane at least in sections along the displacement direction of the carriage.

4. The device according to claim 2, wherein the link has, at one end of the guide recess, a mounting channel through which the guide end of the pivot lever can be inserted into the guide recess when the carriage is mounted on the base plate.

5. The device according to claim 4, wherein a locking element is arranged in the region between the guide recess and the mounting channel in order to prevent the guide end of the pivot lever from slipping out.

6. The device according to claim 1, wherein the link is made integrally with the carriage.

7. The device according to claim 1, wherein the guide end of the pivot lever includes is rounded, includes a ball head, or is hemispherical in shape.

8. The device according to claim 7, wherein the closing guide surface and the opening guide surface are wider than the diameter of the ball head of the pivot lever.

9. The device according to claim 8, wherein the closing guide surface projects laterally beyond the opening guide surface.

10. The device according to claim 1, wherein the link has at at least one end of the guide recess a recess adapted to a shape of the guide end of the pivot lever and into which the guide end of the pivot lever engages for fixing in an end position.

11. The device according to claim 1, wherein the bracket connector is formed in two parts, wherein both connector parts are connected to one another by a sleeve which is connected in a rotationally fixed manner to the pivot lever.

12. The device according to claim 1, wherein the first and second brackets comprise bracket ends which are formed in a straight manner.

13. The device according to claim 12, wherein the bracket ends of the first or second brackets have elongated bracket tips, which are longer than 1 mm.

14. The device according to claim 1, wherein the base plate has at least one bearing section for supporting the bracket connector, wherein the bearing section is formed integrally with the base plate.

15. The device according to claim 1, wherein the device comprises two, three or four pairs of retaining brackets.

16. A folder comprising a front cover and a rear cover and a spine connecting the two covers to one another, having a device according to claim 1.

17. The folder according to claim 16, wherein a fixing device is arranged on the inside of the front cover, and wherein the fixing device fixes at least one pair of retaining brackets in a folded state of the folder such that at least one fixing element fixes the bracket ends of the first or second brackets relative to one another in a straight region of the bracket ends.

18. The folder according to claim 17, wherein a fixing element is provided for a pair of retaining brackets, and wherein the fixing element fixes both bracket ends of the pair of retaining brackets by engaging over them.

19. The folder according to claim 18, wherein the fixing element is configured as a wedge-shaped latching element including rubber.

20. The folder according to claim 17, wherein the fixing device comprises two fixing elements for fixing two pairs of retaining brackets.

21. The folder according to claim 17, wherein the fixing device comprises a receiving device for a data storage unit, where the receiving device is formed as a recess in a base body of the fixing device.

22. The folder according to claim 17, wherein the front cover or the rear cover has a closing flap, which, together with the front cover, rear cover and spine, forms a cover of the folder and can be releasably fixed by magnets.

23. The folder according to claim 17 having a carrying strap.

24. A device for accommodating punched sheets, comprising:

a base plate, at least two pairs of retaining brackets which are configured to be openable and closeable and each have a first bracket and a second bracket, wherein the at least two first brackets are connected to one another via a bracket connector which is connected to the base plate so as to be rotatable about an axis of rotation extending parallel to the base plate and is connected to a pivot lever, and a carriage which is displaceably mounted on the base plate, wherein the carriage has a link comprising a guide recess, wherein the link guides the pivot lever and is configured such that, when the carriage is displaced, the link determines a rotational movement of the pivot lever about the axis of rotation parallel to the base plate in both directions of rotation, wherein the pivot lever has a guide end which engages in the link in the guide recess, wherein the guide end is formed by a free end of the pivot lever and the other end is firmly connected to the bracket connector, wherein the guide recess is delimited by guide surfaces comprising a closing guide surface and an opening guide surface, which cause said pairs of retaining brackets to close and open, respectively, by the guide end of the pivot lever being in contact with the closing guide surface or the opening guide surface, respectively, during the respective movement of the pairs of retaining brackets, wherein, on the side of the link facing the pivot lever, when viewed in the displacement direction of the carriage, the link is shaped in an arcuate manner, and wherein the link has latching or clamping elements at at least one end of the guide recess for releasably fixing the pivot lever in an end position.

* * * * *